US011344163B2

(12) United States Patent
Matthews

(10) Patent No.: US 11,344,163 B2
(45) **Date of Patent: *May 31, 2022**

(54) WEARABLE SANITIZER DISPENSER

(71) Applicant: SANIBEADS, LLC, San Clemente, CA (US)

(72) Inventor: Kimberly Kirby Matthews, San Clemente, CA (US)

( * ) Notice: Subject to any disclaimer, the term of this patent is extended or adjusted under 35 U.S.C. 154(b) by 98 days.

This patent is subject to a terminal disclaimer.

(21) Appl. No.: 16/994,422

(22) Filed: Aug. 14, 2020

(65) Prior Publication Data

US 2020/0375411 A1 Dec. 3, 2020

Related U.S. Application Data

(63) Continuation-in-part of application No. 16/789,312, filed on Feb. 12, 2020, now Pat. No. 10,952,568.

(60) Provisional application No. 62/807,144, filed on Feb. 18, 2019.

(51) Int. Cl.
*A47K 5/12* (2006.01)
*A47K 5/122* (2006.01)

(52) U.S. Cl.
CPC ..... *A47K 5/1201* (2013.01); *A47K 5/122* (2013.01)

(58) Field of Classification Search
CPC .... A47K 5/1201; A47K 5/1413; A47K 5/122; A44C 5/003; A44C 5/0023; A47F 2005/008; B05B 7/1413; A61M 35/00; A61M 35/003; B65D 47/2031
USPC ..... 222/175; 63/1.15
See application file for complete search history.

(56) References Cited

U.S. PATENT DOCUMENTS

| | | | | |
|---|---|---|---|---|
| 2,713,543 | A * | 7/1955 | Peters | B65D 77/30 426/116 |
| 3,270,525 | A * | 9/1966 | Sellers | A44C 15/002 63/23 |
| 5,957,347 | A * | 9/1999 | White | A63B 21/0602 224/148.1 |
| 6,126,041 | A * | 10/2000 | DiTomasso | A63B 21/065 224/148.1 |
| 7,316,332 | B2 * | 1/2008 | Powers | A61M 35/003 222/491 |
| 8,082,753 | B1 * | 12/2011 | Alvarez, Jr. | A45F 3/16 63/3 |
| D672,465 | S * | 12/2012 | Sherman | D24/207 |
| 9,932,133 | B2 * | 4/2018 | Sherman | A61F 7/08 |
| 10,413,025 | B1 * | 9/2019 | Cwalinski | A44C 15/005 |
| 10,952,568 | B2 * | 3/2021 | Matthews | A47K 5/1201 |
| 2004/0016774 | A1 * | 1/2004 | Gentzkow | A61J 7/0046 222/175 |

(Continued)

*Primary Examiner* — Benjamin R Shaw
(74) *Attorney, Agent, or Firm* — Jeffrey Yee; Lewis Brisbois Bisgaard & Smith LLP

(57) ABSTRACT

An apparatus for a wearable sanitizer dispenser that comprises elastic elements filled with liquid sanitizer. Each elastic element is for storing, transporting and dispensing sanitizer. The elastic element has a slit on its surface. The release of liquid sanitizer stored in the elastic element is prompted by compressing the elastic element and squeezing liquid sanitizer through the slit. The slit is also used for inserting liquid sanitizer into the elastic element. Multiple elastic elements can be strung together through the tube, or connected on the exterior of the elements by other elastic elements, and worn as a bracelet or necklace.

13 Claims, 5 Drawing Sheets

(56) References Cited

U.S. PATENT DOCUMENTS

| | | | | |
|---|---|---|---|---|
| 2006/0091156 | A1* | 5/2006 | Powers | A61M 35/003 222/494 |
| 2008/0230560 | A1* | 9/2008 | Powers | A45D 34/00 264/250 |
| 2011/0139823 | A1* | 6/2011 | Staudt | A41D 20/00 222/175 |
| 2011/0155765 | A1* | 6/2011 | Properzi | A47K 5/1201 222/401 |
| 2013/0292414 | A1* | 11/2013 | Sutherland | A47K 5/1201 222/107 |
| 2016/0044997 | A1* | 2/2016 | Horgan | A61M 35/003 222/175 |
| 2018/0071466 | A1* | 3/2018 | White | A44C 5/003 |
| 2021/0177214 | A1* | 6/2021 | Matthews | A44C 5/003 |

* cited by examiner

WEARABLE SANITIZER DISPENSER

CROSS-REFERENCE TO RELATED APPLICATION

This application is a continuation-in-part of U.S. application Ser. No. 16/789,312, filed on Feb. 12, 2020 which claims the benefit of and priority from U.S. provisional application No. 62/807,144 filed on Feb. 18, 2019 and entitled WEARABLE SANITIZER DISPENSER. The contents of the above applications are hereby incorporated herein by reference in full.

FIELD OF INVENTION

This specification relates to a system for transporting, storing, and dispensing sanitizer as a wearable apparatus.

BACKGROUND

The presently described invention provides a convenient and discreet way to apply sanitizer directly onto the user's hand in a situation where using sanitizer may not be deemed appropriate, for instance, in business and social occasions where cleaning the user's hand immediately after a handshake may be considered impolite and inappropriate. It would be desirable to have a sanitizer dispenser that allows the user to dispense sanitizer in a more discreet way. Further, it would be desirable to have a wearable sanitizer dispenser, for example, in a bracelet form on a wrist, to enable direct application of sanitizer onto the user's hand.

SUMMARY

The following presents a simplified summary of one or more embodiments of the present invention in order to provide a basic understanding of such embodiments. This summary is not an exhaustive overview of all contemplated embodiments, and is not intended to delineate the scope of all embodiments.

The objective is to provide a sanitizer dispenser that is wearable and quickly dispenses hand sanitizer directly on the user's hand.

The objective is to provide a hand sanitizer dispenser that is refillable.

The present invention is a sanitizer dispenser. It dispenses sanitizer by compressing an elastic element containing liquid sanitizer to release said sanitizer through an opening of the elastic element. One embodiment of the present invention may be in a form of an attachment to lanyards, strings, or laces. One preferred embodiment of the present invention is a bracelet comprising multiple wearable elastic elements containing liquid sanitizer. A wearable elastic element may be a hollow sphere, comprises a tube encased substantially in the center of the elastic element, creating two openings that are substantially opposite to each other; and a slit on the surface for releasing liquid sanitizer and inserting said sanitizer into the elastic element. The elastic element is preferably made of silicone polymer.

DESCRIPTION OF THE PREFERRED EMBODIMENT

The detailed description of exemplary embodiments herein makes reference to the accompanying drawings and figures, which show the exemplary embodiments by way of illustration and best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. Moreover, any reference to singular includes plural embodiments, and any reference to more than one component may include a singular embodiment.

Figure 1:
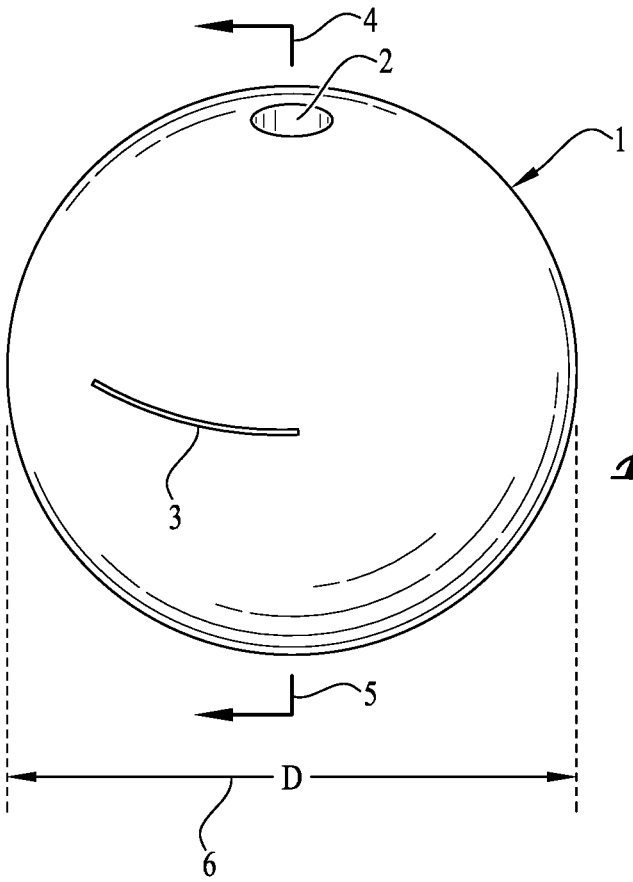
FIG. 1 is a perspective view of elastic wearable beads for dispensing sanitizer.

Referring to FIG. 1, there is disclosed a perspective view of an embodiment of the present invention. An elastic element 1 is a hollow sphere. The diameter of the elastic element 6 is preferably between 14 mm and 16 mm. The elastic element 1 is preferably made of silicone polymer. The elastic element 1 comprises a tube 2, encased substantially in the center of the elastic element 1, creating two openings 4 and 5, preferably between 1 and 4 mm in diameter of the tube 2, that are substantially opposite to each other; and a slit 3, preferably between 4 and 6 mm in length, that is positioned on circumference of the elastic element 1. The length of tube 2 is substantially the same as the diameter of the elastic element 6. The tube 2 need not be cylindrically shaped. The tube 2 can be a channel that allows a string or thread to pass through from one opening 4 and the other opening 5, or vice versa. The openings 4 and 5 are not necessarily circular.

Figure 2:
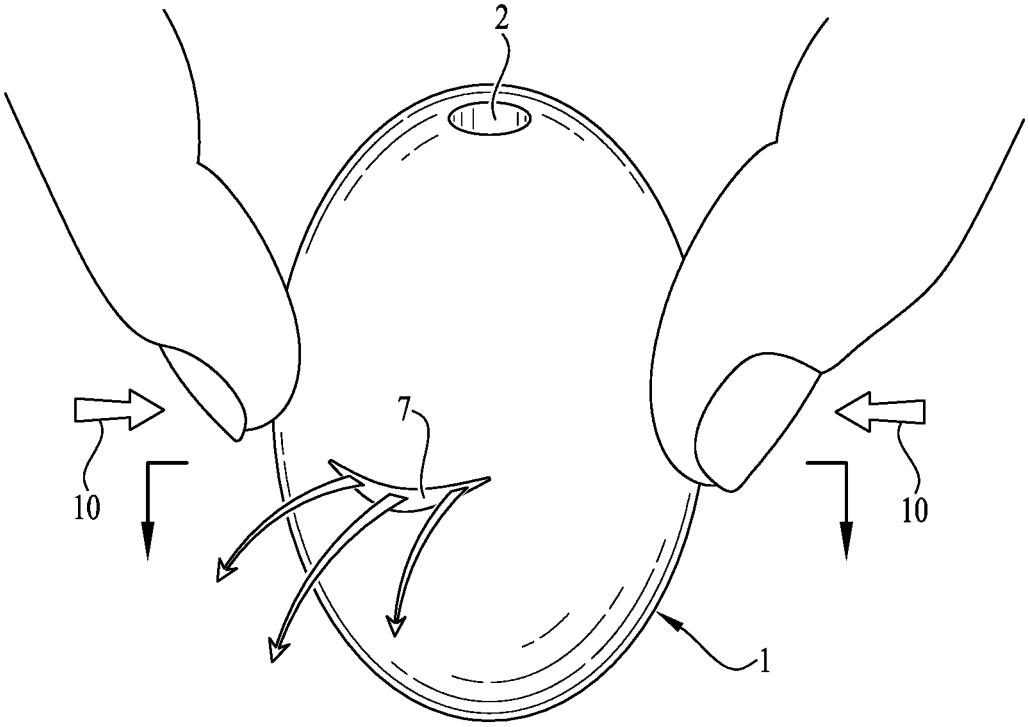
FIG. 2 is another perspective view of an embodiment of the present invention.

Referring to FIG. 2, there is disclosed another perspective view of an embodiment of the present invention containing liquid sanitizer, when deformed 10 releases liquid sanitizer through the slit 7.

Figure 3:
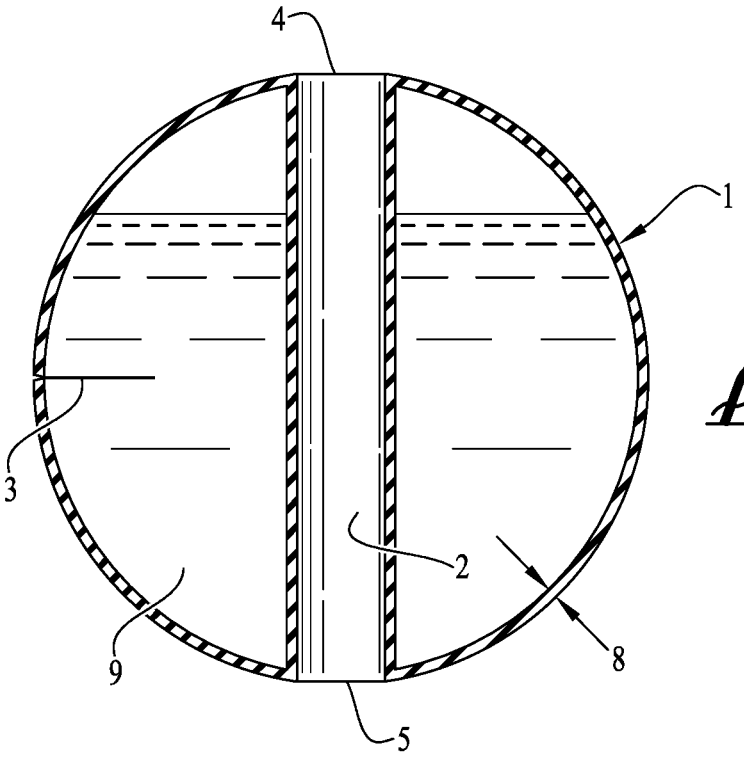
FIG. 3 is a sectional view, saturated with sanitizer, of an embodiment of the present invention.

Referring to FIG. 3, there is disclosed a cross sectional view of an embodiment of the present invention. The tube 2 is used for stringing multiple elastic elements together. A string or thread can pass through from one opening 4 to the other opening 5. The release of liquid sanitizer 9 is controlled by the slit 3 that is substantially sealed hermetically when no pressure is applied to the elastic element 1. The thickness of elastic element 8 is approximately 1 mm.

Figure 4:
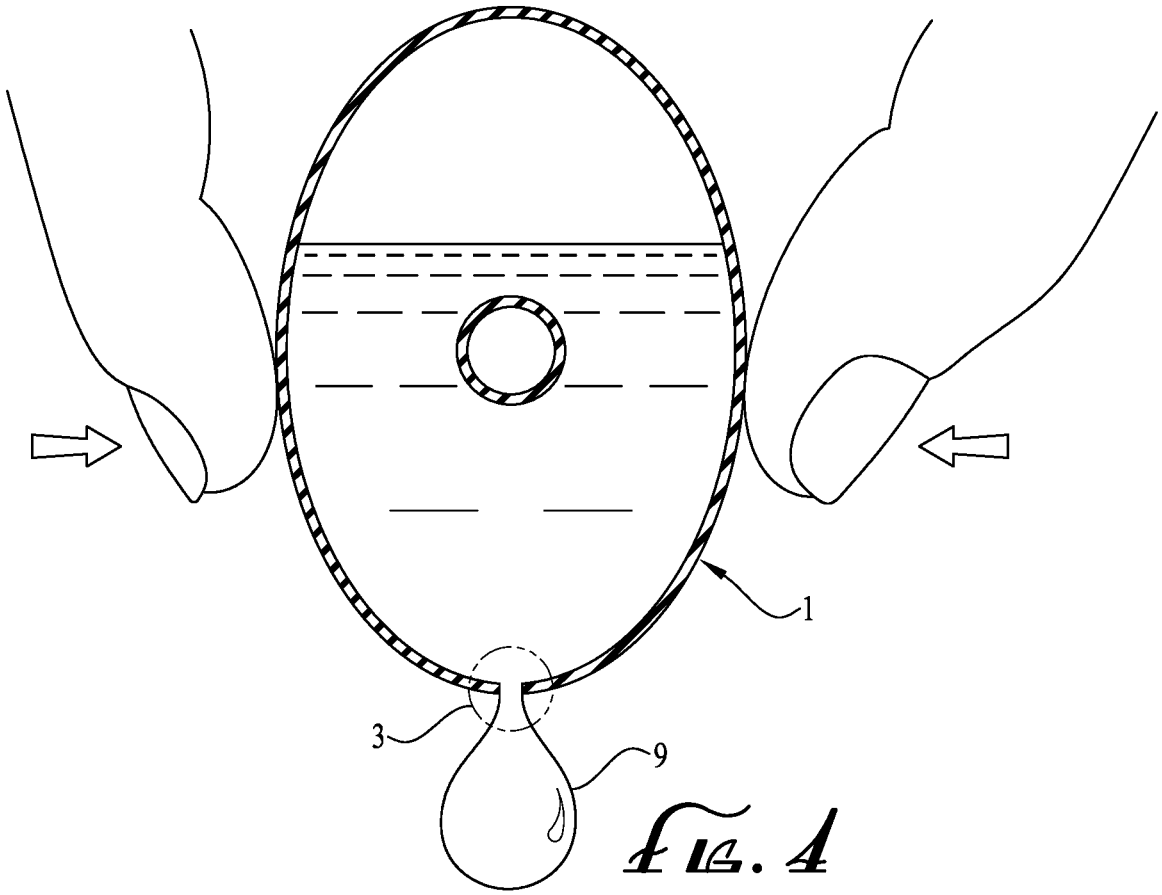
FIG. 4 is a top plan view of an embodiment of the present invention.

Referring to FIG. 4, there is disclosed a top view of an embodiment of the present invention when the user applies pressure to the elastic element 1, resulting in releasing of liquid sanitizer 9 through the slit 3. Said elastic element 1 can hold and dispense approximately 0.0235 fluid ounce of liquid sanitizer 9.

Figure 5:
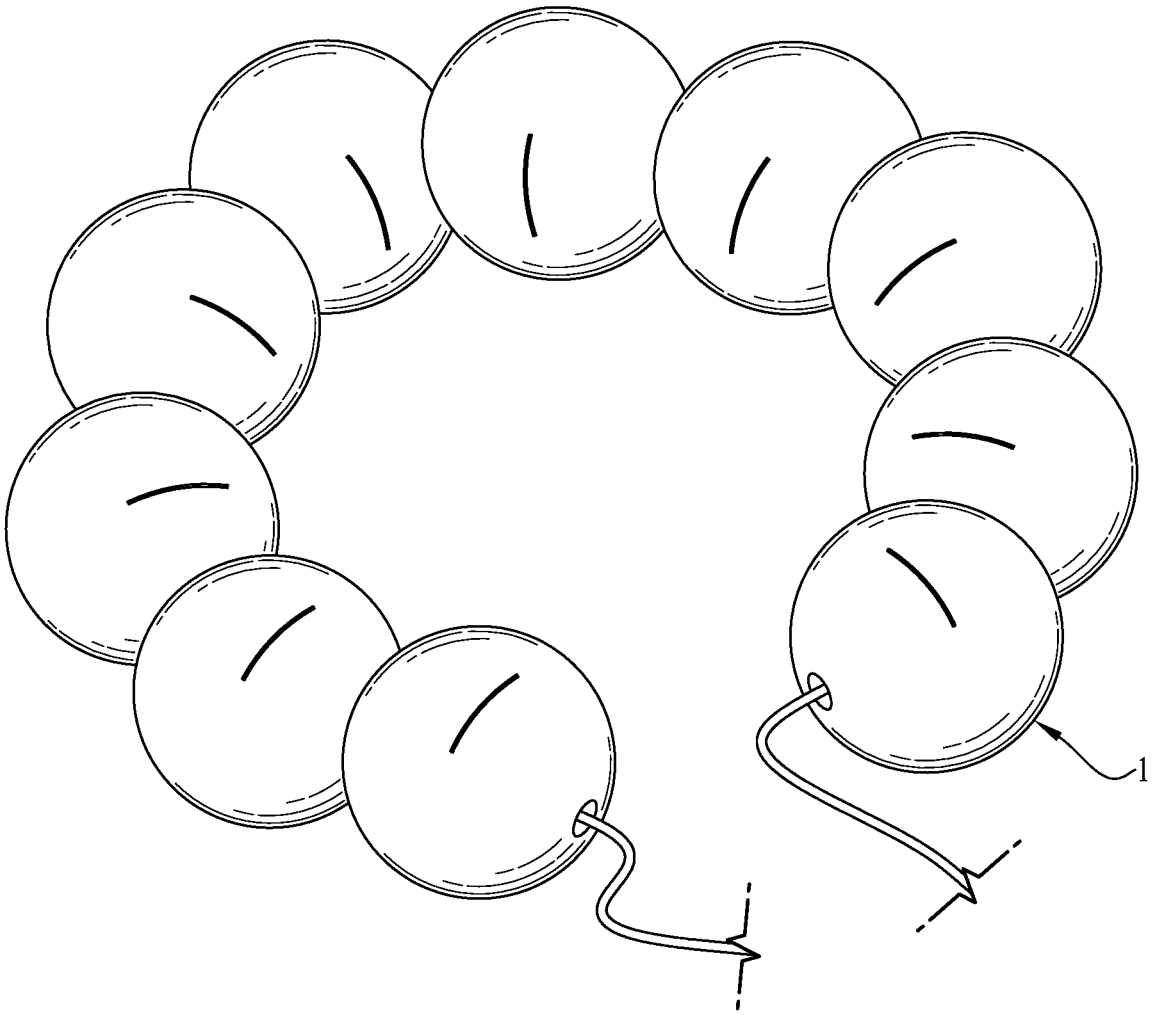
FIG. 5 is a perspective view of an embodiment of the present invention.

Referring to FIG. 5, there is disclosed another embodiment of an embodiment of the present invention in a form of a bracelet, sanitizer saturated elastic elements are strung together. The diameter of the elastic element is approximately 14 mm. The bracelet may comprise 14 to 16 elastic elements. The bracelet may be worn on a user's wrist.

Figure 6A:
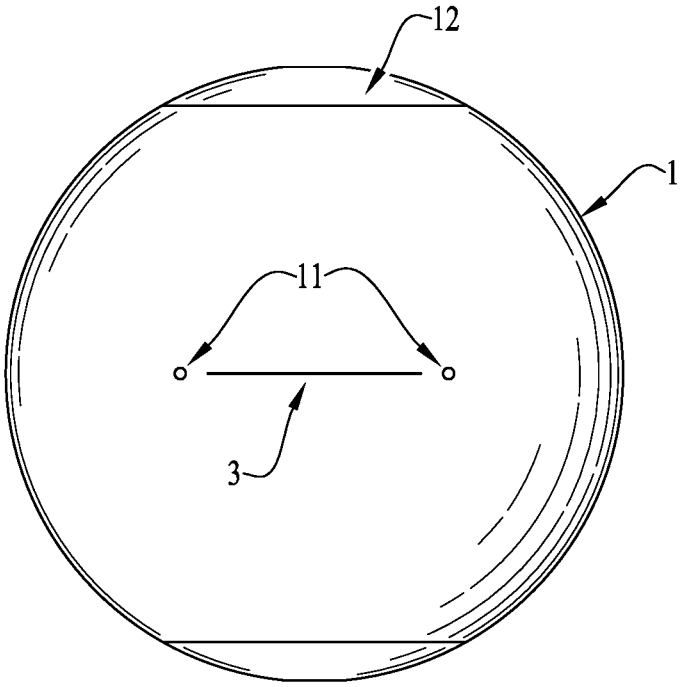
FIG. 6A is a sectional view of an embodiment of the present invention.
Figure 6B:
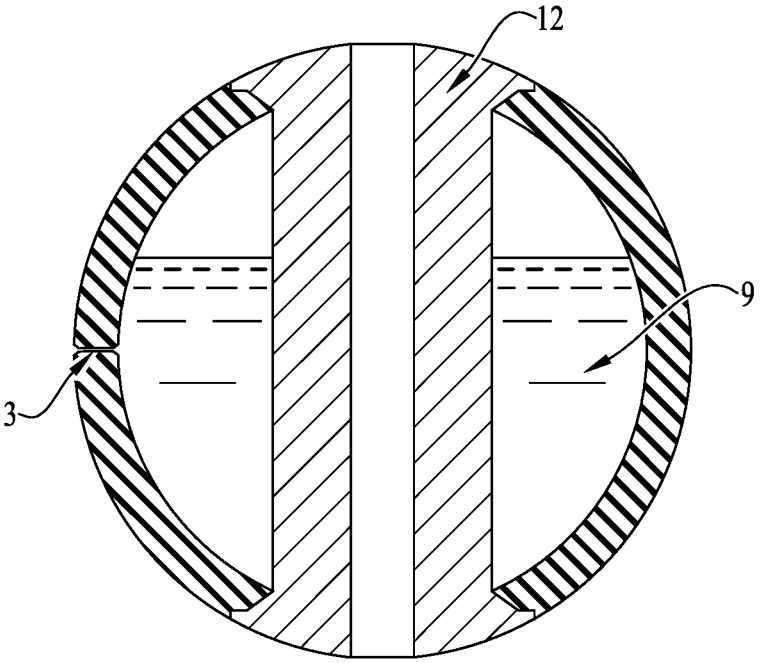
FIG. 6B is another sectional view, saturated with sanitizer, of an embodiment of the present invention.

FIGS. 6A and 6B refer to another embodiment of the present invention which discloses a hollow elastic sphere 1 with a slit 3, similar to that disclosed in FIG. 1. The hollow elastic sphere 1 holds liquid sanitizer 9 and dispenses it through the slit 3. See FIG. 6B. Two raised elements 11 are located near the ends of slit 3. When a user intends to dispense liquid sanitizer through the slit 3, the user could easily locate the slit 3 by way of feeling the locations of the raised elements 11 through touching.

As shown in FIG. 6B, a tube element 12 is encased with the elastic sphere 1 and substantially passing through the center of the elastic sphere 1. The tube element 12 may be in cylindrical shape where the ends are of larger circumference than that of the cylindrical body section of the tube element 12. The tube element, however, does not necessarily in cylindrical shape. The tube element 12 may be removable from the elastic sphere 1. The tube element 12 is substantially rigid and when the tube element 12 is encased with the elastic sphere 1, the ends of the tube element 12 and the elastic sphere 1 are substantially sealed hermetically to prevent leakage of liquid sanitizer 9.

Figure 7:
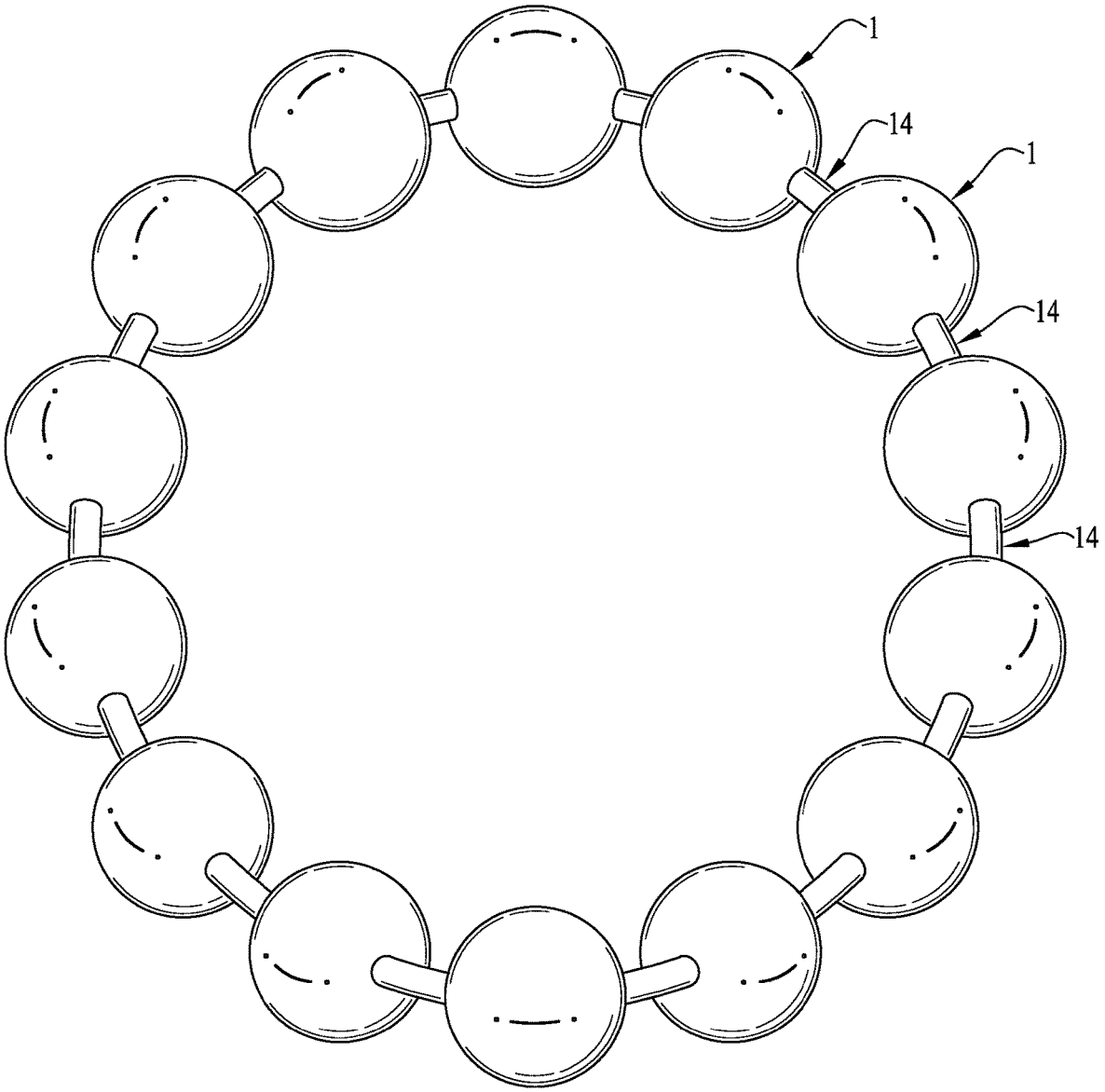
FIG. 7 is perspective view of an embodiment of the present invention.

FIG. 7 refers to yet another embodiment of the present invention in the form of a bracelet or closed loop containing multiple elastic hollow spheres 1. Instead of being strung together, the hollow spheres 1 are connected through multiple connecting elements 14. The connecting elements 14 may be substantially rigid or elastic. The hollow spheres 1 and the connecting elements 14 may be integrated as a one-piece structure through manufacturing process such as injection molding.

The previous description of the disclosed examples is provided to enable any person of ordinary skill in the art to make or use the disclosed apparatus. Various modifications to these examples will be readily apparent to those skilled in the art, and the principles defined herein may be applied to other examples without departing from the spirit or scope of the disclosed apparatus. For example, the wearable sanitizer dispenser may be in other geometrical forms other than sphere, such as oval or cube. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus.

What is claimed is:

1. A wearable elastic device for dispensing sanitizer comprising:

a wearable and reusable elastic element with a slit on the surface of the wearable and reusable elastic element, wherein the wearable and reusable elastic element having an internal reservoir for holding liquid sanitizer and the slit is substantially hermetically sealed when the wearable elastic element is un-deformed; and one or more raised elements protruding from the surface of the wearable and reusable elastic element wherein the raised elements are located near the slit on the surface of the wearable and reusable elastic element.

2. The wearable elastic device for dispensing sanitizer of claim 1, wherein the wearable and reusable elastic element is a hollow sphere.

3. The wearable elastic device for dispensing sanitizer of claim 1, wherein the slit allows for dispensing liquid sanitizer stored in the wearable and reusable elastic element when the elastic element is deformed under pressure.

4. The wearable elastic device for dispensing sanitizer of claim 1, wherein the slit allows for inserting liquid sanitizer into the wearable and reusable elastic element.

5. The wearable elastic device for dispensing sanitizer of claim 1 further comprising a tube element enclosed in the wearable and reusable elastic element and passing through the center of the wearable elastic element, wherein the tube element comprises a body section, two end sections that are substantially opposite to each other wherein each end section has an opening, and a passage way that travels through the body section and between the openings of the end sections; the tube element and the wearable and reusable elastic element are substantially sealed hermetically to prevent leakage of liquid sanitizer.

6. The wearable elastic device for dispensing sanitizer of claim 5, wherein the tube element allows for stringing multiple wearable and reusable elastic elements together.

7. The wearable elastic device for dispensing sanitizer of claim 5, wherein the tube element is removable from the wearable and reusable elastic element.

8. The wearable elastic device for dispensing sanitizer of claim 5, wherein the circumference of each of the end sections of the tube element is larger than the circumference of the body section of the tube element.

9. A wearable elastic device for dispensing sanitizer comprising:

multiple wearable and reusable elastic elements with a slit on the surface of each of the wearable and reusable elastic elements, wherein each of the wearable and reusable elastic element having an internal reservoir for holding liquid sanitizer and the slit of each of the wearable and reusable elastic elements is substantially hermetically sealed when the wearable and reusable elastic element is un-deformed;

one or more connecting elements that connect the multiple wearable and reusable elastic elements to form a closed loop; and one or more raised elements protruding from the surface of each of the wearable and reusable elastic elements wherein the raised elements are located near the slit on the surface of each of the wearable elastic elements.

10. The wearable elastic device for dispensing sanitizer of claim 9, wherein the wearable and reusable elastic elements and the connecting elements are integrated as a one-piece structure.

11. The wearable elastic device for dispensing sanitizer of claim 9, wherein one or more of the wearable and reusable elastic elements is a hollow sphere.

12. The wearable elastic device for dispensing sanitizer of claim 9, wherein the slit of each of the wearable and reusable elastic element allows for dispensing liquid sanitizer stored in the wearable and reusable elastic element when the wearable and reusable elastic element is deformed under pressure.

13. The wearable elastic device for dispensing sanitizer of claim 9, wherein the slit of each of the wearable and reusable elastic element allows for inserting liquid sanitizer into the wearable and reusable elastic element.

* * * * *